US005737671A

United States Patent [19]

Watanabe

[11] Patent Number: 5,737,671

[45] Date of Patent: Apr. 7, 1998

[54] ELECTROPHOTOGRAPHIC PHOTORECEPTOR AND AN IMAGE FORMING METHOD USING THE SAME

[75] Inventor: Masao Watanabe, Kanagawa, Japan

[73] Assignee: Fuji Xerox Co., Ltd., Tokyo, Japan

[21] Appl. No.: 630,253

[22] Filed: Apr. 10, 1996

Related U.S. Application Data

[62] Division of Ser. No. 325,986, Oct. 19, 1994, abandoned.

[30] Foreign Application Priority Data

Oct. 25, 1993 [JP] Japan ..... 5-287338

[51] Int. Cl.[6] ..... G03G 15/00

[52] U.S. Cl. ..... 399/159; 430/56; 430/58; 430/60

[58] Field of Search ..... 355/200, 210, 355/211; 430/56–58, 60–65, 69; 399/159, 26

[56] References Cited

U.S. PATENT DOCUMENTS

| | | | |
|---|---|---|---|
| Re. 33,094 | 10/1989 | Maruyama et al. | 430/57 |
| 3,924,945 | 12/1975 | Weigl | 355/258 |
| 4,361,638 | 11/1982 | Higashi et al. | 430/66 |
| 4,582,773 | 4/1986 | Johncock et al. | 430/65 |
| 4,685,979 | 8/1987 | Nishizawa | 437/81 |
| 4,701,394 | 10/1987 | Inoue et al. | 430/57 |
| 4,851,926 | 7/1989 | Ishikawa | 358/300 |
| 4,898,798 | 2/1990 | Sugata et al. | 430/65 |
| 4,931,876 | 6/1990 | Hashizume | 358/300 |
| 5,053,821 | 10/1991 | Kunugi et al. | 355/245 |
| 5,159,389 | 10/1992 | Minami et al. | 355/211 |
| 5,172,163 | 12/1992 | Yamaoki et al. | 355/210 |
| 5,374,978 | 12/1994 | Asanae et al. | 355/228 X |

FOREIGN PATENT DOCUMENTS

| | | | |
|---|---|---|---|
| 300 807 | 1/1989 | European Pat. Off. | 430/65 |
| 58-4445 | 1/1983 | Japan . | |
| 58-153957 | 9/1983 | Japan . | |
| 61-46961 | 3/1986 | Japan . | |
| 62-28072 | 2/1987 | Japan . | |
| 62-240553 | 10/1987 | Japan . | |
| 2-106761 | 4/1990 | Japan . | |

*Primary Examiner*—Matthew S. Smith

*Attorney, Agent, or Firm*—Finnegan, Henderson, Farabow, Garrett & Dunner, L.L.P.

[57] ABSTRACT

An electrophotographic photoreceptor of the invention comprises a transparent substrate, a transparent conductive layer layered on the transparent substrate, a thin film intermediate layer made of semiconductor material or semiconductor insulating material having a band gap of 2.4 eV or larger, the thin film intermediate layer being formed by a vacuum deposition method and layered on the transparent conductive layer, and an amorphous silicon photoconductive layer layered on the thin film intermediate layer. The electrophotographic photoreceptor is used for an image forming method which comprises an exposure/developing step for carrying out an image exposure process by an exposure means located on the transparent substrate side and substantially at the same time carrying out under a bias voltage applied thereto by a developing means provided on the electrophotographic photoreceptor, and a transferring step for transferring a formed toner image to an image receiving means.

17 Claims, 1 Drawing Sheet

ELECTROPHOTOGRAPHIC PHOTORECEPTOR AND AN IMAGE FORMING METHOD USING THE SAME

This application is a division of application Ser. No. 08/325,986, filed Oct. 19, 1994, now abandoned.

BACKGROUND OF THE INVENTION

The present invention relates to an electrophotographic photoreceptor for an electrophotography system of the type in which an exposure process and a developing process are concurrently carried out, omitting the corona charging process, and an image forming method using the electrophotographic photoreceptor.

A new electrophotography system, which does not use the corona charging process, has been proposed, while the conventional Carlson electrophotography system indispensably uses the charging process by corona discharge. For the new electrophotography system, reference is made to Published Unexamined Japanese Patent Application Nos. Sho. 58-4445, 58-153957, 61-46961, and 62-28072, for example.

In this electrophotography system, the photoreceptor, shaped like a drum or a belt, is formed of a transparent substrate, a transparent conductive layer, and a photoconductive layer layered in this order. To form an image, the transparent substrate of the photoreceptor is exposed to image light, while substantially at the same time, a magnetic brush with conductive magnetic toner to which a bias voltage is applied is made to slidably contact with the surface of the photoreceptor. Accordingly, the electrophotography system can concurrently carry out the charging process, the exposure process, and the developing process. In this electrophotography system, there are proposals of using an amorphous silicon layer for the photoconductive layer (Published Unexamined Japanese Patent Application Nos. Sho. 62-240553 and Hei. 2-106761).

An electrophotography system using an electrophotographic photoreceptor formed by directly forming an amorphous silicon charge-injection blocking layer and a photoconductive layer on the transparent conductive layer by a plasma CVD method, was experimentally operated by the inventors of the present Patent Application. In the experiment, the following disadvantageous facts were confirmed. Peeling-off of the films and defects in the films were observed. The reproductivity of the photoreceptor characteristics was poor. The resistivity of the photoreceptor was low. The contrast was poor.

SUMMARY OF THE INVENTION

The present invention is made to solve the above problems. Accordingly, an object of the present invention is to provide an electrophotographic photoreceptor which successfully solves the problems of peeling-off of the films and defects in the films, and deterioration of the productivity of the photoreceptor characteristics when it is applied to the electrophotography system of the type in which the exposure process and the developing process are concurrently carried out, omitting the corona charging process. Another object of the present invention is to provide an image forming method based on the electrophotography system of the type in which the exposure process and the developing process are concurrently carried out, omitting the corona charging process.

An electrophotographic photoreceptor of the present invention includes a transparent substrate, and is used for an electrophotography system in which the transparent substrate of the photoreceptor is exposed to image light, and a developing process is carried out under a bias voltage applied thereto by a developing means provided on the electrophotographic photoreceptor. The electrophotographic photoreceptor of the invention comprises a transparent substrate, a transparent conductive layer layered on the transparent substrate, a thin film intermediate layer made of semiconductor material or semiconductor insulating material having a band gap of 2.4 eV or larger, the thin film intermediate layer being formed by a vacuum deposition method and layered on the transparent conductive layer, and an amorphous silicon photoconductive layer layered on the thin film intermediate layer.

An image forming method of the present invention uses the electrophotographic photoreceptor thus constructed comprises an exposure/developing step for carrying out an image exposure process by an exposure means located on the transparent substrate side and substantially at the same time carrying out under a bias voltage applied thereto by a developing means provided on the electrophotographic photoreceptor, and a transferring step for transferring a formed toner image to an image receiving means.

DETAILED DESCRIPTION OF THE PREFERRED EMBODIMENTS

The present invention will be described in detail with reference to the accompanying drawings.

Figure 1:
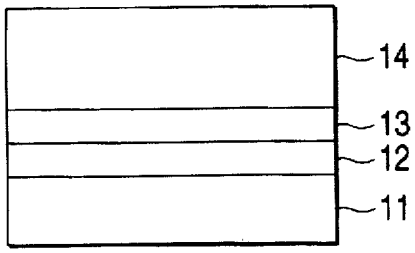
FIG. 1 is a cross sectional view schematically showing an electrophotographic photoreceptor according to the present invention.
Figure 2:
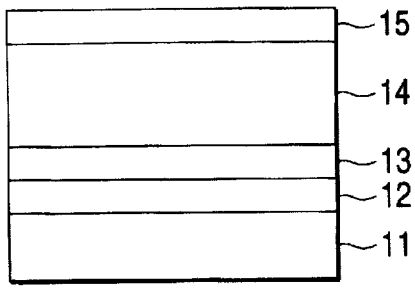
FIG. 2 is a cross sectional view schematically showing another electrophotographic photoreceptor according to the present invention.

FIGS. 1 and 2 show cross sectional views schematically showing two types of electrophotographic photoreceptors constructed according to the present invention. In FIG. 1, a transparent conductive layer 12, a thin film intermediate layer 13, and an amorphous silicon photoconductive layer 14 are layered on a transparent substrate 11 in this order. In the electrophotographic photoreceptor shown in FIG. 2, a surface layer 15 is further formed on the amorphous silicon photoconductive layer.

The transparent substrate of the electrophotographic photoreceptor of the present invention may be shaped like a plate, a drum, a sheet, a belt, or the like. The substrate may be made of any of suitable transparent organic or inorganic materials. Examples of the transparent inorganic materials are glass, quartz, sapphire, and the like. Examples of the organic materials are fluorine plastics, polyester, polycarbonate, polyethylene terephthalate, acrylic resin, polyolefin, epoxy resin, polyamide, polyimide, polyvinyl alcohol, and the like. Additionally, optical fiber, SELFOC optical plate, and the like may be used for the transparent substrate.

The transparent conductive layer layered on the transparent substrate may be made of a transparent conductive material, such as ITO, tin oxide, zinc oxide, lead oxide, indium oxide, or cuprous iodide. Further, a thin film of a metal, such as Al, Ni, or Au, formed by a vapor deposition or a sputtering method, may be used for the transparent conductive layer. In this case, the thin film is thin to such a degree as to be semitransparent.

The thin film intermediate layer is formed on the transparent conductive layer by a vacuum deposition method. The thin film intermediate layer is made of semiconductor material or semiconductor insulating material having a band gap of 2.4 eV or larger. Examples of the semiconductor material are a compound semiconductor composed of elements in the groups I and VII, such as CaS or MgS, another compound semiconductor composed of elements in the groups II and VI, such as $HgI_2$, yet another compound semiconductor composed of elements in the groups III and V, such as AlAs or GaN, still another compound semiconductor composed of elements in the groups IV and VI, such as $TiO_2$ or $SnO_2$, and a further compound semiconductor composed of elements in the groups V and VI, such as $As_2O_3$ or $Bi_2O_3$. Examples of the semiconductor insulating material are oxide and nitride, such as TaOx, SiOx (x>1), and SiAlON. Incidentally, the semiconductor insulating material usually exhibits the nature of an insulating material, but exhibits the semiconductor-like nature since its chemical composition cannot be defined by the stoichiometric quantity.

The band gap of the semiconductor or semiconductor insulating material used for the thin film intermediate layer must be 2.4 eV or larger, preferably within the range of 3 to 7 eV. When the band gap is smaller than 2.4 eV, problem of reduction of the sensitivity arises.

In the present invention, it is necessary to use the vacuum deposition method for forming the semiconductor material or the semiconductor insulating material. If the sputtering method or the ion plating method is used for forming the thin film intermediate layer, the resultant thin film intermediate layer suffers from the following problems. It tends to peel off its lower layer, or the transparent conductive layer, and to be defective. Further, the adhesion properties between the transparent conductive layer and the photoconductive layer are poor. The thickness of the thin film intermediate layer is preferably within the range from 10 to 500 nm.

In the interface between the transparent conductive layer and the amorphous silicon photoconductive layer, this thin film functions as follows. when the photoconductive layer is illuminated or in an illuminated area thereof, the thin film allows charge to be injected from the transparent conductive layer layered on the transparent substrate to the amorphous silicon photoconductive layer since a related electric field is varied by a conductivity variation in the photoconductive layer. When it is not illuminated or in an unilluminated area thereof, the thin film prohibits charge from being injected from the transparent conductive layer to the amorphous silicon photoconductive layer because of their impedance matching owing to the dark resistance of the photoconductive layer, that is, since the impedance of the thin film is equal to the impedance of the photoconductive layer with the dark resistance of the photoconductive layer. A material having such a band gap so as to satisfy the above conditions is used for the thin film. With the provision of the thin film, the impedance difference between the illuminated area of the photoconductive layer and the unilluminated area, viz., the contrast of the resultant image, is large.

The refractivity of the thin film becomes larger with increase of the band gap of the thin film. In the photoreceptor of the invention using the thin film, the absolute value of the quantity of light incident on the photoconductive layer is larger than in the photoreceptor not using the thin film. Additionally, the contrast of it when the photoconductive layer is illuminated and when it is not illuminated is further improved. The preferable range of the refractivity of the thin film is less than 3, preferably within range between 1 and 2.

Further, the thin film functions to prevent metal contained in the electrode material from diffusing into the photoconductive layer, and improves the adhesion properties in the interface between the transparent conductive layer and the photoconductive layer.

The amorphous silicon photoconductive layer is layered on the thin film intermediate layer. In order to modify the physical properties of the thin film intermediate layer, such as conductivity, band gap, and surface hardness, some of the elements of the silicon may be substituted by hydrogen, oxygen, nitrogen, germanium, tin, sulfur, or the like. When a LED head is used for a light source, the amorphous silicon photoconductive layer can efficiently receive light emitted from the LED. When an EL head is used, the wave lengths of light emitted from the EL head are deviated to the short wave length side. Accordingly, in this case, it is preferable to broaden the band gap by adding chemical elements, such as carbon, oxygen, and nitrogen, to the a-Si layer. When a semiconductor laser is used, the wavelengths of light emitted from the semiconductor laser are deviated to the long wave length side, it is preferable to narrow the band gap by adding chemical elements, such as germanium and tin, to the A-Si layer.

The electrical characteristics of the amorphous silicon photoconductive layer may be adjusted by adding elements of the subgroup IIIa and elements of the subgroup Va.

A glow discharge method, a sputtering method, an ECR method, a vacuum deposition method, or the like may be used for forming the amorphous silicon photoconductive layer. In forming this layer, it is preferable to add elements for the dangling bond termination, such as hydrogen atoms or halogen atoms to the amorphous silicon layer. The thickness of the amorphous silicon photoconductive layer is preferably within the range between 1 to 5 μm.

An insulating layer or a high resistance layer made of organic or inorganic material may be formed as a surface layer on the surface of the amorphous silicon photoconductive layer of the electrophotographic photoreceptor of the invention.

Polyethylene terephtalate, polycarbonate, polyester, and polyparaxylene may be used for the organic material for the insulating layer. To form the insulating layer of any of these materials, the coating or vapor deposition method may be used. The inorganic material for the insulating material or the high resistance layer may be silicon carbide.

Additionally, silicon nitride, silicon oxide, silicon oxycarbide, and silicon oxy-nitride may be used for the high resistance layer. A plasma CVD method or a vapor deposition method is used for forming the surface layer, such as an a-SiC layer or an a-SiN layer. A preferable thickness of the surface layer is within the range of 0.01 to 1 μm.

The electrophotographic photoreceptor of the present invention is used for an electrophotography system in which the image exposure process is carried out by an exposure means located on the transparent substrate side and substantially at the same time the developing process is carried out under a bias voltage applied thereto by a developing means provided on the electrophotographic photoreceptor. An image forming method using the electrophotographic photoreceptor will be described with reference to the accompanying drawing.

Figure 3:
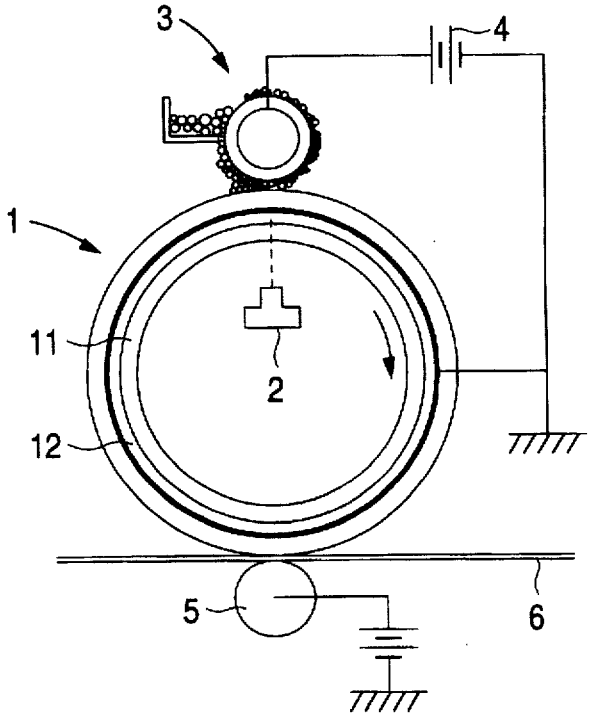
FIG. 3 is a diagram schematically showing an image forming apparatus used for executing an image forming method according to the present invention.

FIG. 3 is a diagram schematically showing an image forming apparatus based on the image forming method of the present invention. An exposure light source, for example, an LED head 2, is located on the transparent substrate 11 side of an electrophotographic photoreceptor 1.

A developing unit 3 is located on the surface side of the electrophotographic photoreceptor 1 in opposition to the LED head. The developing unit is formed of a cylindrical magnetic roller and a sleeve disposed around the roller. One component magnetic/conductive toner as a developer stored in a toner receptacle, is disposed outside of the sleeve, thereby forming a magnetic brush. A bias voltage source 4 is inserted between the sleeve and a transparent conductive layer 12 layered on the transparent substrate. The bias voltage source 4 applies positive or negative voltage of 10 to 300 V between the sleeve and the conductive layer depending on the potential characteristic of the electrophotographic photoreceptor. A transfer roll 5 is located in the bottom of the electrophotographic photoreceptor.

In the operation to form an image, the transparent substrate 11 of the rotating electrophotographic photoreceptor 1 is exposed to image light emitted from the LED head 2. As a result, holes and electrons are generated in the amorphous silicon photoconductive layer. In this case, if a positive bias voltage is applied to the developing unit 3, the bias voltage causes electrons to move to the surface of the amorphous silicon photoconductive layer. The moved electrons neutralize positive charges on the tips of the magnetic brush or the electrons and the charges attract to each other. As a result, the conductive toner is attached to the surface of the electrophotographic photoreceptor. A toner image thus formed on the surface of the electrophotographic photoreceptor is transferred and fixed onto a recording paper 6 by the transfer roll 5.

An EL head, a laser head, or the like may be used for the light source, in place of the LED head. The developer may be conductive toner formed by dispersing pigment or magnetic powder into thermoplastic resin or another conductive toner containing conductive powder added thereto. Use of the conductive toner containing conductive powder is preferable.

The present invention will be described in more detail using some examples and a comparison.

(EXAMPLE 1)

An ITO layer as a transparent conductive layer was formed, 100 nm thick, on the surface of a cylindrical transparent glass substrate by an ion plating method. A TaOx (x=1.8) layer as a thin film intermediate layer was formed, 50 nm thick, on the ITO layer by a vacuum deposition method. The band gap of this layer was 5.0 eV.

An a-Si layer and an a-SiN surface layer were successively formed on the thus formed TaOx layer under the film forming conditions shown in Table 1. In this case, a capacitor type glow discharge apparatus was used.

TABLE 1

| | $SiH_4$ (sccm) | $H_2$ (sccm) | $NH_3$ (sccm) | Gas Pressure (Pa) | RF Power (W) | Film thickness (μm) |
|---|---|---|---|---|---|---|
| a-SiN surface layer | 100 | 100 | 150 | 133.3 (1.0 Torr) | 200 | 0.2 |
| a-Si layer | 100 | 100 | — | 1.0 | 200 | 3 |

Photoconductivity σp and dark conductivity σd of the thus formed electrophotographic photoreceptor when an intensity of light is 50 μW/cm$^2$ were measured. Photoconductivity σp and dark conductivity σd were $10^{-8}$ (1/Ωcm) and $10^{-12}$ (1/Ωcm), respectively.

The adhesion properties in the interface between the TaOx layer and the a-Si layer were excellent, and the film peeling-off was not observed for these layers. No diffusion of indium from the ITO was confirmed through the measurement by using the secondary ion mass spectrometry (SIMS). Thus, the fact that the electrophotographic photoreceptor of the invention has a high dark/light conductivity ratio was confirmed.

The electrophotographic photoreceptor was set to the image forming apparatus of FIG. 3. +100 V was applied between the sleeve and the transparent substrate. The electrophotographic photoreceptor was exposed to image light of 660 nm of wave length and 0.4 μJ/cm$^2$ of exposure. A toner image thus formed on the electrophotographic photoreceptor was transferred and fixed onto a recording paper. To prepare a developer, 100 parts by weight of stylene-acrylic resin and 100 parts by weight of magnetic powder were molten, kneaded, ground, and classified, thereby obtaining toner particles of 12 μm in average particle diameter. Carbon black of 20 nm in average particle diameter, 0.8%, was mixed into the toner particles, thereby forming conductive toner.

The resultant image was evaluated. The results of the evaluation showed: The resolution of the image was high, no fog was formed on the background of the image, and an optical density of the image was 1.2.

(COMPARISON)

An electrophotographic photoreceptor having no thin film intermediate layer is presented, for the vehicle of comparison.

An ITO layer as a transparent conductive layer was formed, 100 nm thick, on the surface of a cylindrical transparent glass substrate by an ion plating method. An a-Si layer and an a-SiN surface layer were successively formed on the ITO layer under the film forming conditions shown in Table 2, by using a capacitor type glow discharge apparatus.

TABLE 2

| | $SiH_4$ (sccm) | $H_2$ (sccm) | $NH_3$ (sccm) | Gas Pressure (Pa) | RF Power (W) | Film thickness (μm) |
|---|---|---|---|---|---|---|
| a-SiN surface layer | 100 | 100 | 150 | 133.3 (1.0 Torr) | 200 | 0.2 |
| a-Si layer | 100 | 100 | — | 1.0 | 200 | 3 |

Photoconductivity σp and dark conductivity σd of the thus formed electrophotographic photoreceptor when an intensity of light is 50 μW/cm$^2$ were measured. Photoconductivity σp and dark conductivity σd were $10^{-5}$ (1/Ωcm) and $10^{-7}$ (1/Ωcm), respectively.

The electrophotographic photoreceptor was set to the image forming apparatus of EXAMPLE 1, and subjected to the exposure process and the developing process under similar conditions. The result was no formation of an image on the electrophotographic photoreceptor.

The analysis by the SIMS showed that a trace of indium was diffused into the ITO. The reason why the image is not formed may be considered that the diffused indium is put as donor in a deep level in the a-Si photoconductive layer, so that the resistivity of the a-Si photoconductive layer becomes low.

(EXAMPLE 2)

To form an electrophotographic photoreceptor, a transparent conductive layer and a thin film intermediate layer were formed on a transparent substrate as in EXAMPLE 1. An a-Si layer and an a-SiC surface layer were successively formed on the thin film intermediate layer under film forming conditions shown in Table 3.

TABLE 3

| | $SiH_4$ (sccm) | $H_2$ (sccm) | $C_2H_4$ (sccm) | Gas Pressure (Pa) | RF Power (W) | Film thickness (μm) |
|---|---|---|---|---|---|---|
| a-Si surface layer | 100 | 100 | 150 | 133.3 (1.0 Torr) | 200 | 0.2 |
| a-Si layer | 100 | 100 | — | 1.0 | 200 | 3 |

Photoconductivity σp and dark conductivity σd of the thus formed electrophotographic photoreceptor when an intensity of light is 50 $\mu W/cm^2$ were measured. Photoconductivity σp and dark conductivity σd were $10^{-8}$ (1/Ωcm) and $10^{-13}$ (1/Ωcm), respectively.

The adhesion properties in the interface between the TaOx layer and the a-Si layer were excellent, and the film peeling-off was not observed for these layers. No diffusion of indium from the ITO was confirmed through the measurement by using the SIMS. Thus, the fact that the electrophotographic photoreceptor of the invention has a high dark/light conductivity ratio was confirmed.

The electrophotographic photoreceptor was set to the image forming apparatus of FIG. 3. +100 V was applied between the sleeve and the transparent substrate. The electrophotographic photoreceptor was exposed to image light of 660 nm of wave length and 0.4 $\mu J/cm^2$ of dosage. A toner image thus formed on the electrophotographic photoreceptor was transferred and fuzed onto a recording paper.

The resultant image was evaluated. The results of the evaluation showed: The resolution of the image was high, no fog was formed on the background of the image, and an optical density of the image was 1.2. The fact that the electrophotographic photoreceptor is high in breakdown voltage and in photosensitivity was confirmed.

As seen from the foregoing description, the electrophotographic photoreceptor of the present invention includes the thin film intermediate layer which is made of semiconductor material or semiconductor insulating material having a band gap of 2.4 eV or larger, and formed by a vacuum deposition method. Adhesion of the amorphous silicon photoconductive layer to the transparent conductive layer is improved. There is no deterioration of the electrical characteristics of the amorphous silicon photoconductive layer, which is caused by the diffusion of a trace of metal from the transparent conductive layer to the amorphous silicon photoconductive layer. Further, the dark/light conductivity ratio of the photoreceptor can be controlled without increasing the thickness of the photoconductive layer, so that a high photosensitivity is secured. An excellent image of high optical density and free from the background fog can be formed in a manner that the image exposure process is carried out by an exposure means located on the transparent substrate side and substantially at the same time the developing process is carried out under a bias voltage applied thereto by a developing means provided on the electrophotographic photoreceptor.

What is claimed is:

1. An electrophotographic apparatus comprising:

an electrophotographic photoreceptor having:

a transparent substrate, a transparent conductive layer layered on the transparent substrate, a thin film intermediate layer made of semiconductor material or semiconductor insulating material having a band gap of at least 2.4 eV, the thin film intermediate layer being formed by vacuum deposition on the transparent conductive layer, and an amorphous silicon photoconductive layer on the thin film intermediate layer;

developing means located on one side of the photoreceptor, the one side being adjacent to a surface of the photoconductive layer;

exposing means located on a side of the photoreceptor opposite from the one side; and bias means for applying a bias voltage between the substrate and the developing means to cause one of holes and electrons to move to the surface of the photoconductive layer.

2. An electrophotographic apparatus according to claim 1, wherein said thin film intermediate layer has a band gap in a range of 3 eV to 7 eV.

3. An electrophotographic apparatus according to claim 1, wherein said transparent conductive material is selected from the group consisting of ITO, tin oxide, zinc oxide, lead oxide, indium oxide, and cuprous iodide.

4. An electrophotographic apparatus according to claim 3, wherein said oxides and nitrides are selected from the group consisting of TaOx, SiOx (x>1), and SiAlON.

5. An electrophotographic apparatus according to claim 1, wherein said semiconductor material is selected from groups consisting of a compound semiconductor composed of elements in the groups I and VII, a compound semiconductor composed of elements in the groups II and VI, a compound semiconductor composed of elements in the groups III and V, a compound semiconductor composed of elements in the group IV and VI, and a compound semiconductor composed of elements in the groups V and VI.

6. An electrophotographic apparatus according to claim 1, wherein said semiconductor insulating material is selected from the group consisting of oxides and nitrides.

7. An electrophotographic apparatus according to claim 1, wherein the thickness of said amorphous silicon photoconductive layer is within a range between 1 μm and 5 μm.

8. An electrophotographic apparatus comprising:

an electrophotographic photoreceptor having:

a transparent substrate, a transparent conductive layer connected to a biasing source layered on the transparent substrate;

a thin film intermediate layer made of semiconductor material or semiconductor insulating material having a band gap of at least 2.4 eV, the thin film intermediate layer being formed by vacuum deposition on the transparent conductive layer and having a band gap in a range of 5 eV to 7 eV, and an amorphous silicon photoconductive layer on the thin film intermediate layer.

9. An image forming method comprising the steps of:

providing, in an electrophotographic apparatus, an electrophotographic photoreceptor having a transparent substrate, a transparent conductive layer connected to a biasing source on the transparent substrate, a thin film intermediate layer made of semiconductor material or semiconductor insulating material with a band gap of at least 2.4 eV an amorphous silicon photoconductive layer applied to one surface of the thin film intermediate layer;

exposing an image on the transparent substrate side and substantially simultaneously developing said image with a developing means provided on the electrophotographic photoreceptor while applying a bias voltage between the substrate and the developing means to cause one of holes and electrons to move to the surface of the photoconductive layer; and transferring a formed toner image to an image receiving means.

10. The image forming method of claim 9, wherein said thin film intermediate layer has a band gap in a range of 3 eV to 7 eV.

11. The image forming method comprising the steps of:

providing, in an electrophotographic apparatus, an electrophotographic photoreceptor having a transparent substrate, a transparent conductive layer connected to a biasing source on the transparent substrate, a thin film intermediate layer made of semiconductor material or semiconductor insulating material with a band gap in a range of 5 eV to 7 eV, and an amorphous silicon photoconductive layer applied to one surface of the thin film intermediate layer;

exposing an image on the transparent substrate side and substantially simultaneously developing said image with a developing means provided on the electrophotographic photoreceptor; and transferring a formed toner image to an image receiving means.

12. An electrophotographic apparatus comprising an electrophotographic photoreceptor having a transparent substrate, a transparent conductive layer connected to a biasing source on the transparent substrate, and an amorphous silicon photoconductive layer on the transparent conductive layer, the electrophotographic photoreceptor being applied to an image recording system in which the photoreceptor is illuminated with a light from the transparent substrate side and at the same time an illuminated area of the photoreceptor is developed from the transparent conductive layer side, characterized in that a thin film is provided between the transparent conductive layer and the amorphous silicon photoconductive layer, wherein said thin film has a band gap of at least 2.4 eV thereby allowing a charge to be injected from the transparent conductive layer to the amorphous silicon photoconductive layer when the amorphous silicon photoconductive layer is illuminated with the light, and prohibiting a charge from being injected from the transparent conductive layer to the amorphous silicon photoconductive layer when the amorphous silicon photoconductive layer is not illuminated.

13. An electrophotographic apparatus according to claim 12, wherein said thin film has a band gap in a range of 3 eV to 7 eV.

14. An electrophotographic apparatus according to claim 12, wherein said thin film is TaOx (x=1.0 to 2.5).

15. An electrophotographic apparatus comprising an electrophotographic photoreceptor having a transparent substrate, a transparent conductive layer connected to a biasing source on the transparent substrate, and an amorphous silicon photoconductive layer on the transparent conductive layer, the electrophotographic photoreceptor being applied to an image recording system in which the photoreceptor is illuminated with a light from the transparent substrate side and at the same time an illuminated area of the photoreceptor is developed from the transparent conductive layer side, characterized in that a thin film is provided between the transparent conductive layer and the amorphous silicon photoconductive layer, wherein said thin film has a band gap in a range of 5 eV to 7 eV, thereby allowing a charge to be connected from the transparent conductive layer to the amorphous silicon photoconductive layer when the amorphous silicon photoconductive layer is illuminated with the light, and prohibiting a charge from being injected from the transparent conductive layer to the amorphous silicon photoconductive layer when the amorphous silicon photoconductive layer is not illuminated.

16. An electrophotographic apparatus comprising an electrophotographic photoreceptor having a transparent substrate, a transparent conductive layer connected to a biasing source on the transparent substrate, and an amorphous silicon photoconductive layer on the transparent conductive layer, the electrophotographic photoreceptor being applied to an image recording system in which the photoreceptor is illuminated with a light from the transparent substrate side and at the same time an illuminated area of the photoreceptor is developed from the transparent conductive layer side, characterized in that a thin film is provided between the transparent conductive layer and the amorphous silicon photoconductive layer, wherein said thin film has a band gap of at least 2.4 eV thereby allowing a charge to be injected from the transparent conductive layer to the amorphous silicon photoconductive layer when the amorphous silicon photoconductive layer is illuminated with the light, and prohibiting a charge from being injected from the transparent conductive layer to the amorphous silicon photoconductive layer when the amorphous silicon photoconductive layer is not illuminated, said thin film having a refractivity no greater than 3.

17. An electrophotographic apparatus comprising an electrophotographic photoreceptor having a transparent substrate, a transparent conductive layer connected to a biasing source on the transparent substrate, and an amorphous silicon photoconductive layer on the transparent conductive layer, the electrophotographic photoreceptor being applied to an image recording system in which the photoreceptor is illuminated with a light from the transparent substrate side and at the same time an illuminated area of the photoreceptor is developed from the transparent conductive layer side, characterized in that a thin film is provided between the transparent conductive layer and the amorphous silicon photoconductive layer, wherein said thin film has a band gap of at least 2.4 eV thereby allowing a charge to be injected from the transparent conductive layer to the amorphous silicon photoconductive layer when the amorphous silicon photoconductive layer is illuminated with the light, and prohibiting a charge from being injected from the transparent conductive layer to the amorphous silicon photoconductive layer when the amorphous silicon photoconductive layer is not illuminated, said thin film having a refractivity in a range of 1 to 2.

* * * * *

UNITED STATES PATENT AND TRADEMARK OFFICE

CERTIFICATE OF CORRECTION

PATENT NO. : 5,737,671

DATED : April 07, 1998

INVENTOR(S) : Masao WATANABE

It is certified that error appears in the above-identified patent and that said Letters Patent is hereby corrected as shown below:

Claim 1, column 8, line 15, "adjactent" should read --adjacent--.

* Claim 15, column 10, line 11, "connected" should read --injected--.

Signed and Sealed this

Fourth Day of April, 2000

*Attest:*

*Attesting Officer*

Q. TODD DICKINSON

*Director of Patents and Trademarks*